US010133208B2

(12) United States Patent
Tamura

(10) Patent No.: US 10,133,208 B2
(45) Date of Patent: Nov. 20, 2018

(54) IMAGE FORMING APPARATUS HAVING OPERATION GUIDE LABEL

(71) Applicant: KYOCERA Document Solutions Inc., Osaka (JP)

(72) Inventor: Takashi Tamura, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 15/695,255

(22) Filed: Sep. 5, 2017

(65) Prior Publication Data

US 2018/0067420 A1 Mar. 8, 2018

(30) Foreign Application Priority Data

Sep. 7, 2016 (JP) ..... 2016-175028

(51) Int. Cl.
*G03G 15/08* (2006.01)

(52) U.S. Cl.
CPC ..... *G03G 15/0868* (2013.01); *G03G 15/0882* (2013.01); *G03G 2215/0687* (2013.01); *G03G 2215/088* (2013.01)

(58) Field of Classification Search
CPC ..... G03G 15/0841; G03G 15/0882; G03G 2215/0687; G03G 2215/088; B65D 17/28; B65D 17/40; B65D 17/4011; B65D 17/402; B65D 17/50; B65D 47/103
USPC ..... 399/106; 222/541.9, DIG. 1
See application file for complete search history.

(56) References Cited

U.S. PATENT DOCUMENTS

| | | | | |
|---|---|---|---|---|
| 4,981,218 A * | 1/1991 | Ban | G03G 15/0882 222/DIG. 1 |
| 6,266,501 B1 * | 7/2001 | Mizuishi | G03G 15/0849 399/103 |
| 2003/0161644 A1 * | 8/2003 | Yokoi | G03G 21/1832 399/27 |

FOREIGN PATENT DOCUMENTS

| | | | |
|---|---|---|---|
| JP | 03031877 A | * | 2/1991 |
| JP | 11338210 A | * | 12/1999 |
| JP | 2000181221 A | * | 6/2000 |
| JP | 2003131482 A | * | 5/2003 |
| JP | 2004-157254 | | 6/2004 |
| JP | 2005091398 A | * | 4/2005 |

* cited by examiner

*Primary Examiner* — Robert Beatty
(74) *Attorney, Agent, or Firm* — Wenderoth, Lind & Ponack, L.L.P.

(57) ABSTRACT

An operation guide label is made to perform a display urging a seal member for sealing a toner replenishment port of a toner container received in an image forming apparatus to be pulled out. The image forming apparatus has a first side surface provided with a power switch and a second side surface adjacent to the first side surface and provided with an opening and closing cover for toner container exchange. The seal member has a grasping part which protrudes from a surface of the toner container. The operation guide label includes a first label part adhered to the first side surface so as to cover at least a part of the power switch, a second label part adhered to a predetermined surface part on the side of the opening and closing cover in the image forming apparatus, and a connection part for connecting the both label.

8 Claims, 12 Drawing Sheets

IMAGE FORMING APPARATUS HAVING OPERATION GUIDE LABEL

CROSS-REFERENCE TO RELATED APPLICATION

This application is based upon and claims the benefit of priority from Japanese Patent Application No. 2016-175028 filed on Sep. 7, 2016, the entire contents of which are incorporated herein by reference.

BACKGROUND

The technology of the present disclosure relates to an operation guide label.

There is a case where a toner container received in an image forming apparatus is provided with a seal member for preventing leakage of toner from a toner replenishment port. The seal member is configured with a belt-like member for sealing the toner replenishment port and one end portion of the seal member protrudes from a front side of the toner container in an attachment/detachment direction. A user hold one end portion of the seal member with his/her hands to pull out the seal member, so that the sealing of the toner replenishment port is released. If a user allows the image forming apparatus to operate without pulling out the seal member, since the toner replenishment port has been sealed, toner replenishment to a photosensitive drum from the toner replenishment port is not performed and thus a print error occurs.

In this regard, in the related image forming apparatus, an operation guide label is adhered to an outer side surface of the image forming apparatus to attract user's attention. The operation guide label is made to perform a display (a sentence or a picture) urging pulling-out of the seal member before the use of the image forming apparatus is started.

SUMMARY

An operation guide label according to one aspect of the present disclosure is made to perform a display urging a seal member for sealing a toner replenishment port of a toner container received in an image forming apparatus to be pulled out.

The aforementioned image forming apparatus has a first side surface and a second side surface. The first side surface is provided with a power switch. The second side surface is adjacent to the first side surface and is provided with an opening and closing cover for toner container exchange. The aforementioned seal member has a grasping part. The grasping part protrudes from a surface of the aforementioned toner container, which faces the aforementioned opening and closing cover side. The grasping part is graspable by a user when the seal member is pulled out. The aforementioned operation guide label includes a first label part, a second label part, and a connection part. The first label part is adhered to the aforementioned first side surface so as to cover at least a part of the aforementioned power switch. The second label part is adhered to a predetermined surface part on the opening and closing cover side in the image forming apparatus. The connection part connects the first label part and the second label part to each other.

DETAILED DESCRIPTION

Hereinafter, an example of an embodiment will be described on the basis of the drawings. It is noted that the technology of the present disclosure is not limited to the following embodiments.

Figure 1:
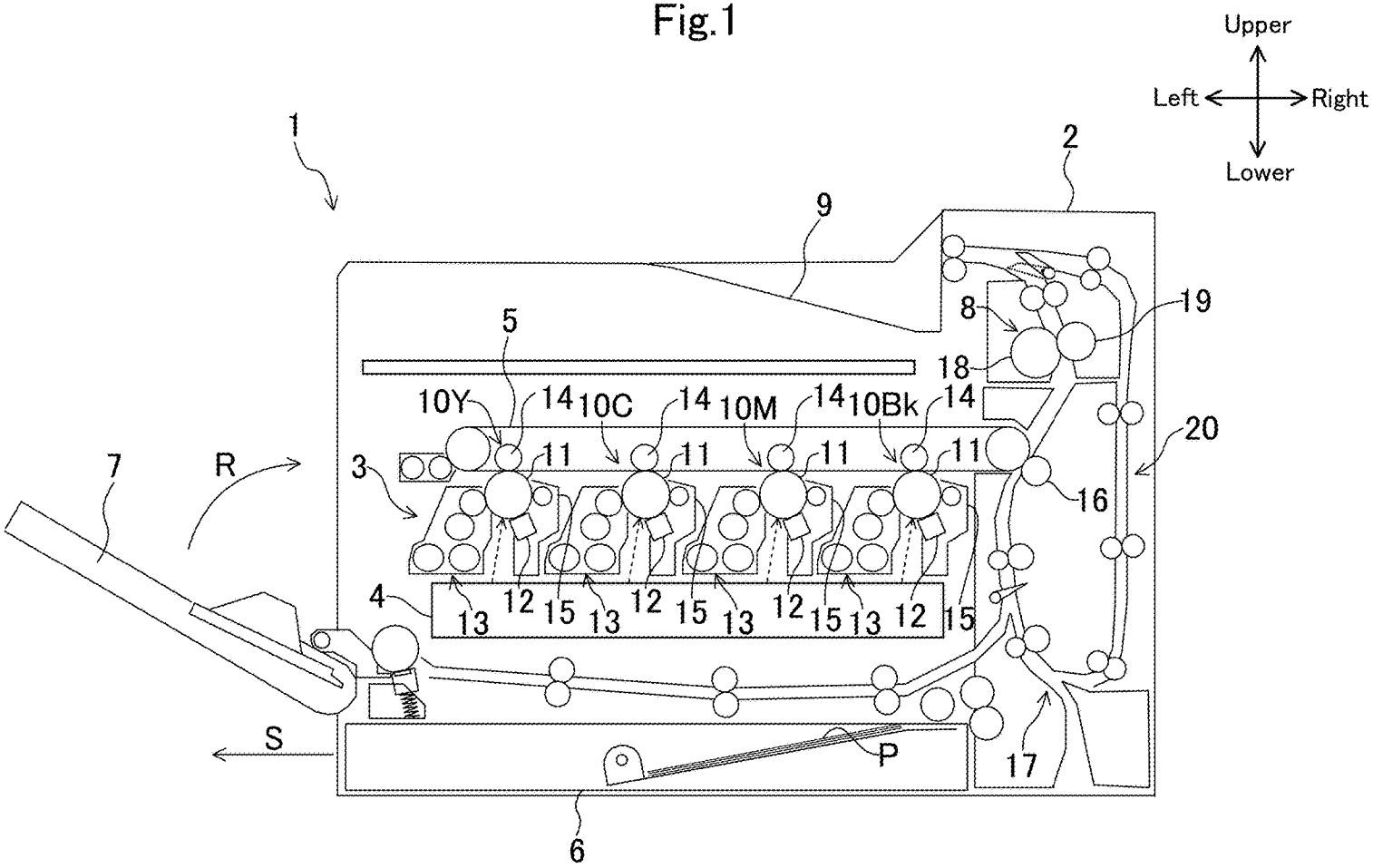
FIG. 1 is an overall view illustrating a schematic configuration of an image forming apparatus with an operation guide label adhered thereto according to an embodiment adhered thereto.

FIG. 1 illustrates a schematic configuration diagram of an image forming apparatus 1 in an embodiment. The image forming apparatus 1 is a tandem type color printer and includes an image forming unit 3 in a box-like casing 2. A front side and a back side of FIG. 1 are respectively defined as a front side and a rear side of the image forming apparatus 1, and a left side and a right side of FIG. 1 are respectively defined as a left side and a right side of the image forming apparatus 1.

Figure 3:
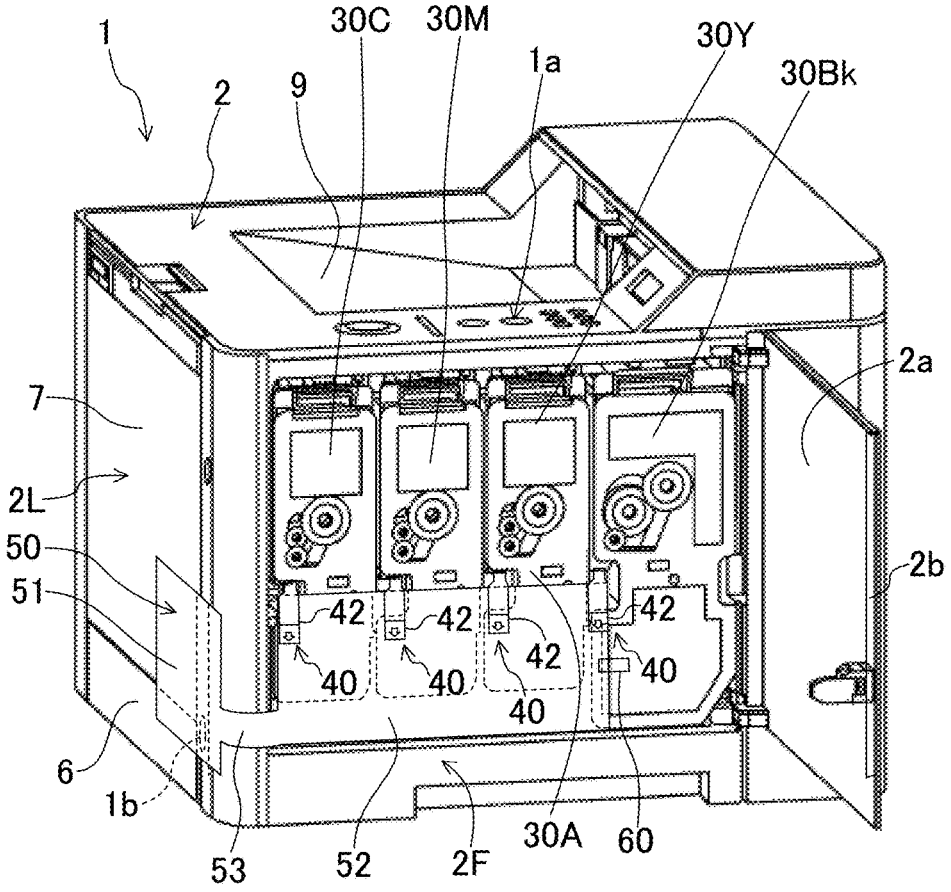
FIG. 3 is a perspective view of an external appearance of an image forming apparatus, which illustrates a state in which an opening and closing cover is opened.

In a space of a front end portion in the casing 2, toner containers 30Bk, 30M, 30C, and 30Y (see FIG. 3) are received, and the image forming unit 3 is arranged at a rear side of the toner containers 30Bk, 30M, 30C, and 30Y.

The image forming unit 3 transfers an image to a recording sheet P and forms the image on the recording sheet P on the basis of image data transmitted from an external device such as a computer subjected to network connection and the like. Below the image forming unit 3, an opposed scanning type optical scanning device 4 is arranged to irradiate light beam (laser light), and above the image forming unit 3, an intermediate transfer belt 5 is arranged.

Below the optical scanning device 4, a sheet feed cassette 6 is arranged to store the recording sheet P, and at a left side of the optical scanning device 4, a manual feed tray 7 is arranged. The sheet feed cassette 6 is able to be drawn out of the image forming apparatus 1 by sliding leftward (a direction S of an arrow of FIG. 1). The manual feed tray 7 is rotatable in a direction R of the drawing by employing its lower end edge as a fulcrum, so that the manual feed tray 7 can be folded.

At a lateral upper part of the intermediate transfer belt 5, a fixing unit 8 is arranged to perform a fixing process on the image transferred to and formed on the recording sheet P. A reference numeral 9 indicates a sheet discharge unit arranged at an upper portion of the casing 2 to discharge the recording sheet P subjected to the fixing process in the fixing unit 8.

The image forming unit 3 includes four image forming units 10Bk, 10M, 10C, and 10Y arranged in a row along the intermediate transfer belt 5. These image forming units 10Bk, 10M, 10C, and 10Y form toner images of black, magenta, cyan, and yellow, respectively.

Specifically, each of the image forming units 10Bk, 10M, 10C, and 10Y has a photosensitive drum 11. Directly under each photosensitive drum 11, a charging device 12 is arranged, and at one side of each photosensitive drum 11, a developing device 13 is arranged. Directly above each photosensitive drum 11, a primary transfer roller 14 is arranged, and at the other side of each photosensitive drum 11, a cleaning unit 15 is arranged to clean the peripheral surface of the photosensitive drum 11.

The peripheral surface of each photosensitive drum 11 is uniformly charged by the charging device 12, and laser light corresponding to each color component based on the image data inputted from the aforementioned computer and the like is irradiated to the charged peripheral surface of each photosensitive drum 11 from the optical scanning device 4, so that an electrostatic latent image is formed on the peripheral surface of each photosensitive drum 11. A developer is supplied to the electrostatic latent image from the developing device 13, so that a toner image of black, magenta, cyan, or yellow is formed on the peripheral surface of each photosensitive drum 11. These toner images are superposed on and transferred to a lower surface of the intermediate transfer belt 5 by a transfer bias applied to the primary transfer roller 14.

A reference numeral 16 indicates a secondary transfer roller arranged below the fixing unit 8 in the state of abutting the intermediate transfer belt 5, the recording sheet P conveyed along a sheet conveyance path 17 from the sheet feed cassette 6 or the manual feed tray 7 is interposed between the secondary transfer roller 16 and the intermediate transfer belt 5, and the toner images on the intermediate transfer belt 5 are transferred to the recording sheet P by a transfer bias applied to the secondary transfer roller 16.

The fixing unit 8 includes a heating roller 18 and a pressure roller 19, wherein the recording sheet P is interposed by the heating roller 18 and the pressure roller 19 so as to be heated and pressed, so that the toner images, which have been transferred to the recording sheet P, are fixed to the recording sheet P. The recording sheet P subjected to the fixing process is discharged to the sheet discharge unit 9. A reference numeral 20 indicates a reversing conveyance path for reversing the recording sheet P discharged from the fixing unit 8 at the time of duplex printing.

Figure 2:
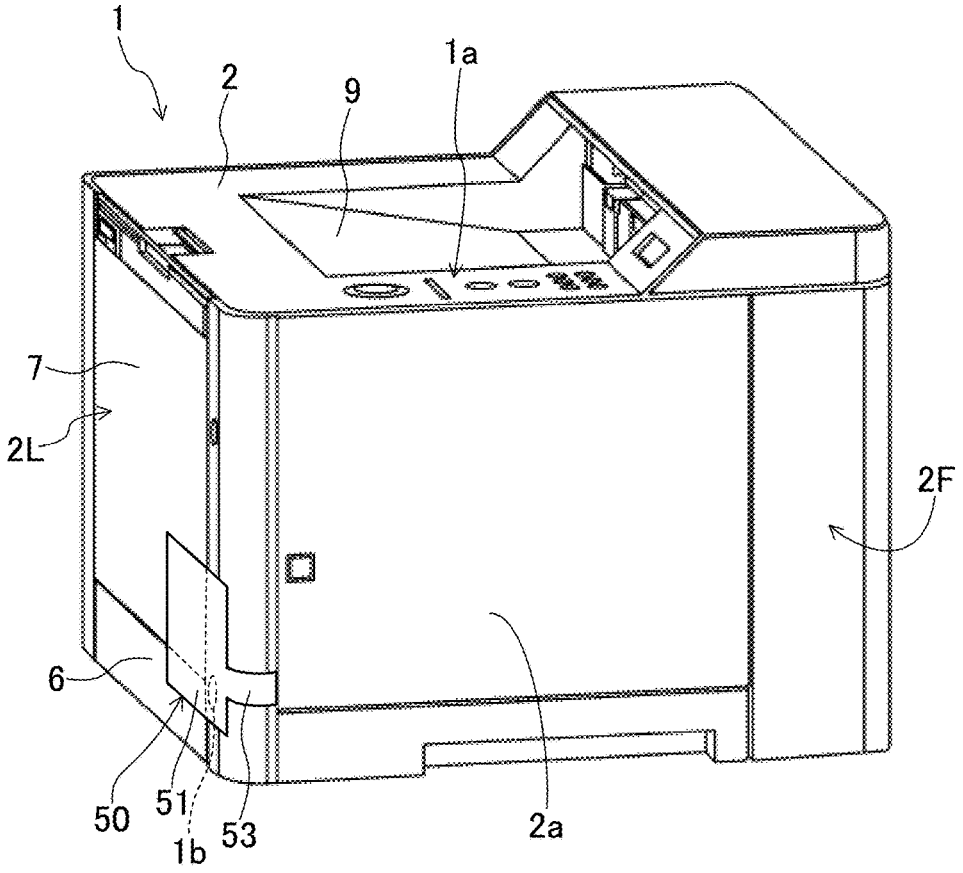
FIG. 2 is a perspective view of an external appearance illustrating an image forming apparatus.

FIG. 2 illustrates a perspective view of an external appearance of the image forming apparatus 1. As illustrated in the same drawing, at a front end portion on an upper surface of the casing 2, an operating unit 1*a* is provided to allow a user to perform various types of setting and instructions with respect to the image forming apparatus 1.

The casing 2 is provided on the left side surface (corresponding to a first side surface) 2L thereof with a power switch 1*b* for supplying power to the image forming apparatus 1. An intermediate part, except for both end portions on the left side surface 2L of the casing 2 in a front and rear direction, is formed by a back surface of the manual feed tray 7 in a folded state and a left side surface of the sheet feed cassette 6 in a receiving state. The manual feed tray 7 is adjacent to the sheet feed cassette 6 and is arranged at an upper side of the sheet feed cassette 6. The power switch 1*b* is provided in the vicinity of a right side of the sheet feed cassette 6 on the left side surface 2L of the casing 2. The power switch 1*b* is covered by an operation guide label 50 to be described later.

The casing 2 is provided on the front side surface (corresponding to a second side surface) 2F thereof with an opening and closing cover 2*a* having an approximately rectangular plate shape. The opening and closing cover 2*a* is rotatable in the front and rear direction by employing a shaft extending along its own right end edge in the up and down direction as a fulcrum. A user can open the opening and closing cover 2*a*, thereby exchanging the toner containers 30Bk, 30M, 30C, and 30Y received in the front end portion of the casing 2 (see FIG. 3).

The toner containers 30Bk, 30M, 30C, and 30Y are respectively filled with toner of each color of black, magenta, cyan, and yellow. The toner containers 30Bk, 30M, 30C, and 30Y are arranged adjacent to one another in the right and left direction when viewed from the front side of the image forming apparatus 1. Each of the toner containers 30Bk, 30M, 30C, and 30Y is detachably guided by a guide rail (not illustrated) in the front and rear direction. The toner containers 30Bk, 30M, 30C, and 30Y are allowed to slide in the front and rear direction so as to be detachable from the image forming apparatus 1.

Figure 4:
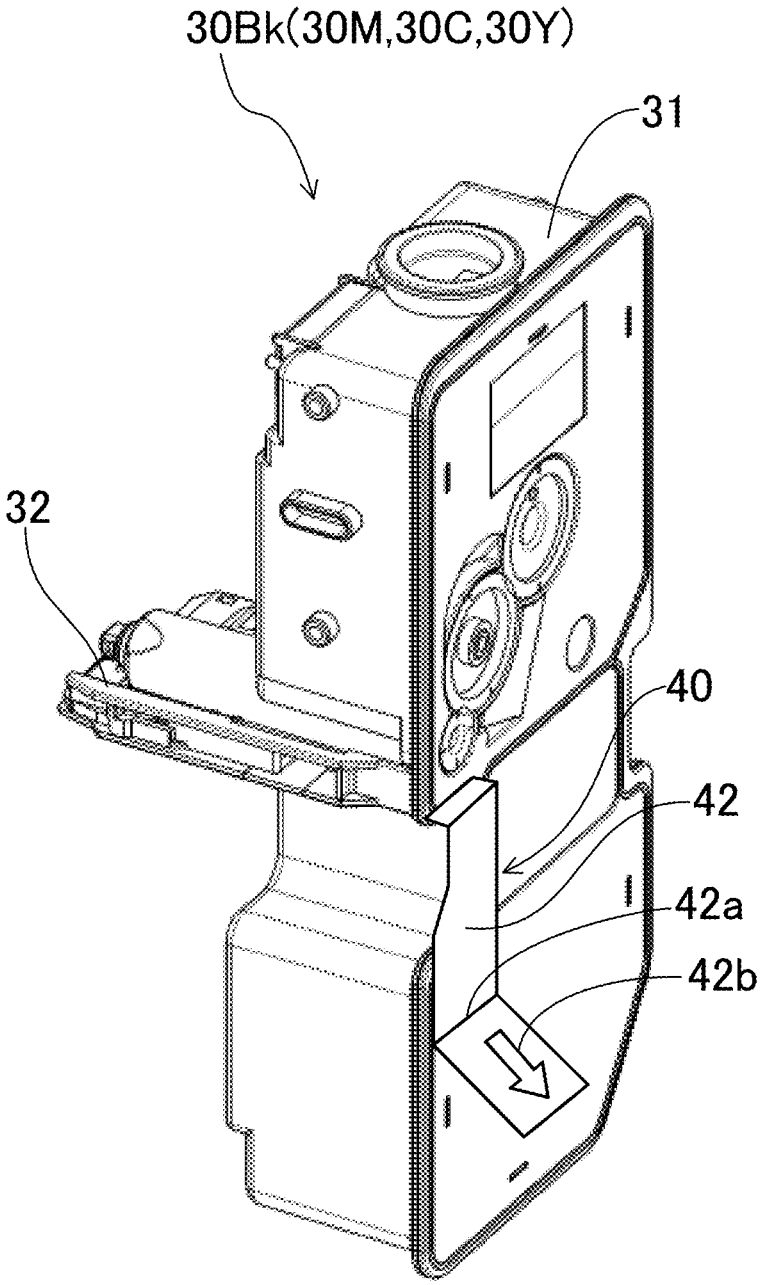
FIG. 4 is a perspective view of an external appearance when viewed from a front left side of a container, which illustrates an example of a toner container mounted to an image forming apparatus.
Figure 5:
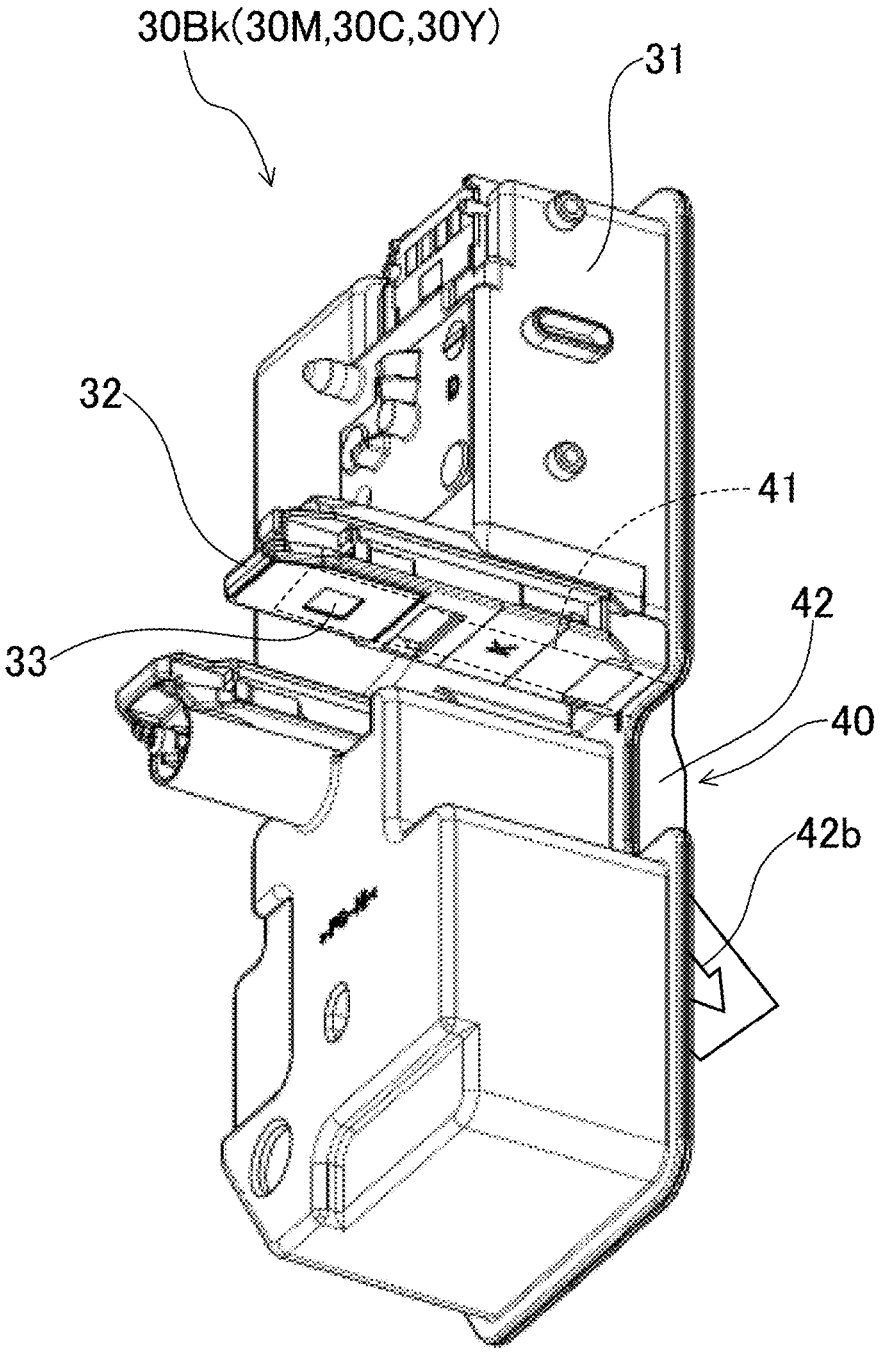
FIG. 5 is a perspective view of an external appearance when viewed from a rear left side of a container, which illustrates an example of a toner container mounted to an image forming apparatus.

In the four toner containers 30Bk, 30M, 30C, and 30Y, only the toner container 30Bk of black has a shape different from those of the other three toner containers, but they have the same basic configuration. That is, as illustrated in FIG. 4 and FIG. 5, each of the toner containers 30Bk, 30M, 30C, and 30Y (FIG. 4 illustrates only the toner container 30Bk of black as an example) has a flat container body 31 for storing toner and a replenishment cylinder part 32 protruding rearward from a rear side surface of the flat container body 31. A replenishment port 33 (illustrated only in FIG. 5) penetrates a lower surface of a distal end portion of the replenishment cylinder part 32. The replenishment port 33 is formed to be matched with a toner receiving port (not illustrated) of the developing device 13.

Figure 6:
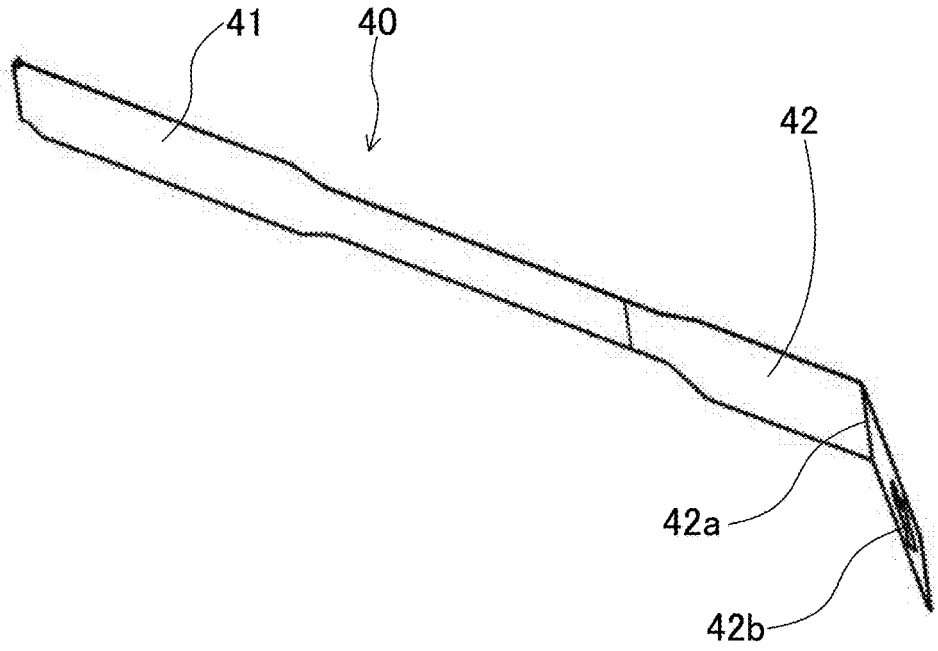
FIG. 6 is a perspective view of an external appearance illustrating a seal member provided to a toner container.

The replenishment port 33 has been sealed by a seal member 40 (see FIG. 6) when a user has purchased the image forming apparatus 1. The seal member 40 is configured to be able to be drawn out by a user. Specifically, the seal member has a belt-like slide seat part 41 that seals the replenishment port 33 and is slidable along the replenishment cylinder part 32, and a grasping part 42 concatenated to a front end portion of the slide seat part 41. The grasping part 42 protrudes from the front side surface of each of the toner containers 30Bk, 30M, 30C, and 30Y. A distal end portion of the grasping part 42 is bent in an oblique upper direction via a fold line 42*a*.

When a user grasps the grasping part 42 and pulls it frontward, the slide seat part 41 slidably moves frontward, so that the sealing of the replenishment port 33 by the slide seat part 41 is released. At the distal end portion of the grasping part 42, an arrow 42*b* is displayed to allow a user to recognize a drawing-out direction of the seal member 40.

The seal member 40 is provided, so that it is possible to prevent toner in the toner containers 30Bk, 30M, 30C, and 30Y from being leaked from the replenishment port 33 during transportation of the image forming apparatus 1 shipped from a factory for example. However, when a print operation of the image forming apparatus 1 is started while the replenishment port 33 is being sealed by the seal member 40, the image forming apparatus 1 stops due to a print error. As a consequence, a user misunderstands that the image forming apparatus 1 has been broken or a user is forced to perform a restoration operation from the print error. In order to solve this problem, an operation guide label 50 is adhered to the image forming apparatus 1.

Figure 7:
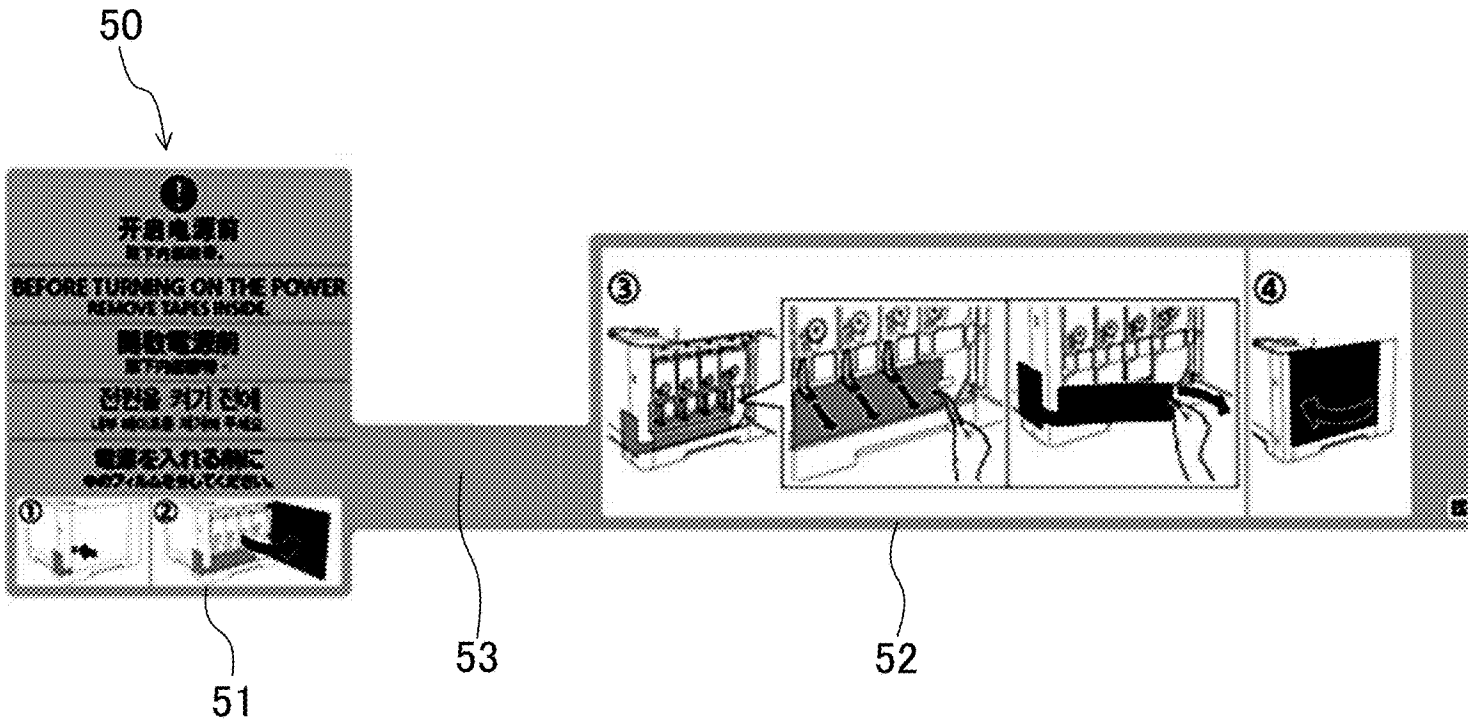
FIG. 7 is a plan view illustrating an operation guide label according to an embodiment.

As illustrated in FIG. 7, the operation guide label 50 has a first label part 51, a second label part 52, and a belt-like connection part 53 for connecting the both label parts 51 and 52 to each other. Both label parts 51 and 52 are made to perform a display urging the seal member 40 to be pulled out. This display, for example, includes a sentence, a picture, or a combination of the sentence and the picture. In the present embodiment, as an example, in the first label part 51, a sentence, which includes a plurality of words for urging the seal member 40 to be pulled out before turning on the power, and a picture, which shows an operation procedure, are respectively displayed in upper and lower sides. The second label part 52 illustrates only a picture showing an operation procedure.

Figure 8:
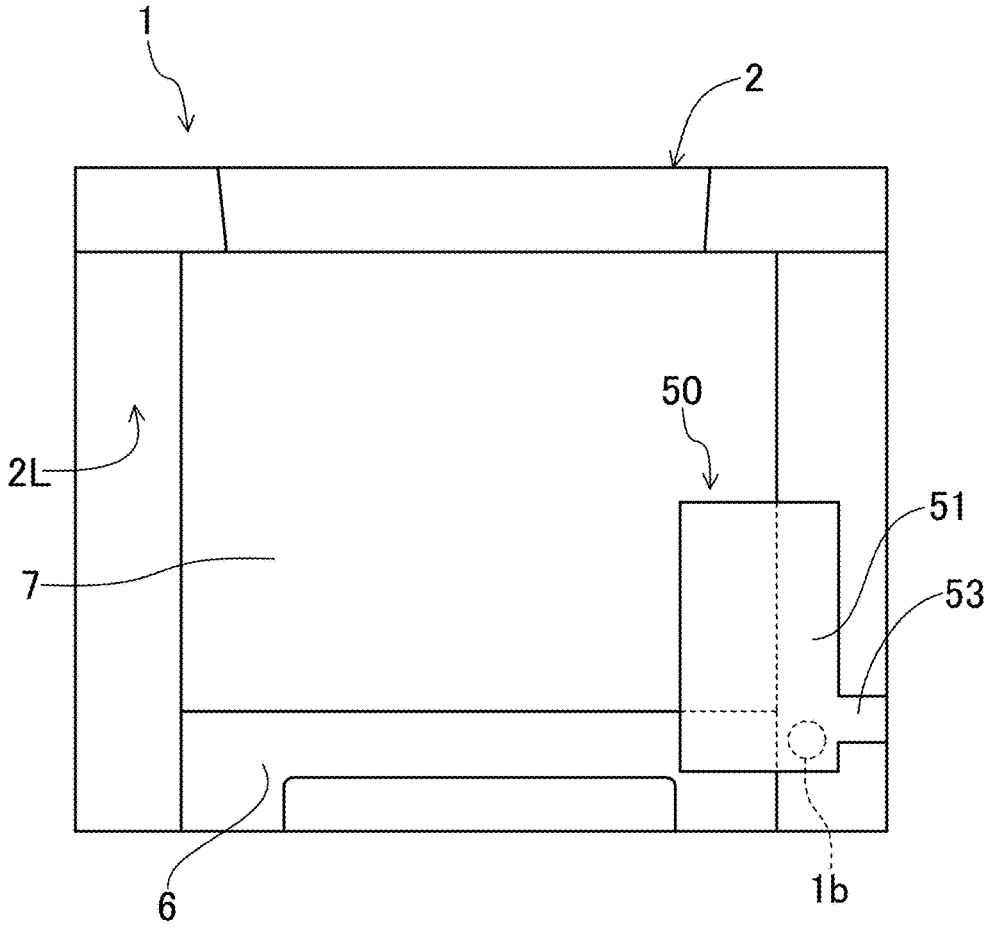
FIG. 8 is a side view when an image forming apparatus is viewed from a left side.

As illustrated in FIG. 8, the first label part 51 has a rectangular sheet shape long in the up and down direction. The first label part 51 is adhered to the left side surface 2L of the casing 2 so as to cover the entire power switch 1*b*, the front and lower corner parts of the manual feed tray 7 in a closed state, and the front and upper corner parts of the sheet feed cassette 6. The first label part 51 has an adhesive surface on the whole of one side surface in a thickness direction, and is adhered to the left side surface 2L of the casing 2 via the adhesive surface. The first label part 51 is configured by, for example, a synthetic sheet so as not to be simply torn when it is peeled off.

Figure 9:
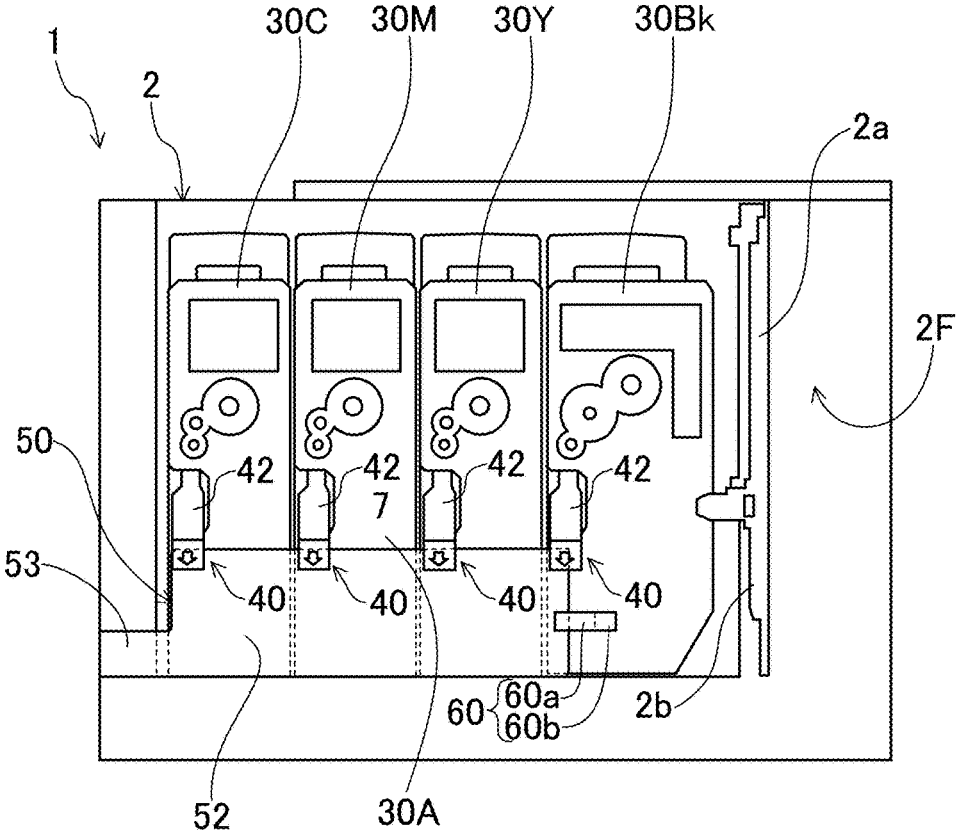
FIG. 9 is a side view when an image forming apparatus is viewed from a front side in a state in which an opening and closing cover is opened.

As illustrated in FIG. 9, the second label part 52 has a rectangular sheet shape long in the right and left direction. The second label part 52 is adhered to a predetermined surface part 30A including a part of the front side surface of each of the toner containers 30Bk, 30M, 30C, and 30Y. The predetermined surface part 30A is a flat surface on the opening and closing cover 2*a* side (a front side in the present embodiment). The second label part 52 is arranged across the whole of the lower end portions of the three toner containers 30C, 30M, and 30Y and the left end portion of the lower end portion of the toner container 30Bk of black. The second label part 52 itself has no adhesive surface as with the first label part 51. That is, the second label part 52 is adhered to the surface part 30A by an adhesive member 60 forming a separate body from the operation guide label 50. In present embodiment, a right end portion of the second label part 52 is fixed to the front side surface of the toner container 30Bk by the adhesive member 60.

The adhesive member 60 has a rectangular sheet shape extending in the right and left direction in a whole view. The adhesive member 60 has an adhesive part 60*a* having an adhesive surface across the right end portion of the second label part 52 and the toner container 30Bk, and a non-adhesive part 60*b* concatenated to a right end portion of the adhesive part 60*a*. A fold line is formed in a boundary line between the adhesive part 60*a* and the non-adhesive part 60*b*, and the non-adhesive part 60*b* is inclined frontward from the fold line as a boundary and is slightly floated from the front side surface of the toner container 30Bk.

The upper end portion of the second label part 52 overlaps the distal end portion of the grasping part 42 of the seal member 40 protruding from the front side surfaces of the toner containers 30Bk, 30M, 30C, and 30Y. The upper end portion of the second label part 52 may overlap the entire grasping part 42 as well as the distal end portion of the grasping part 42.

Figure 10:
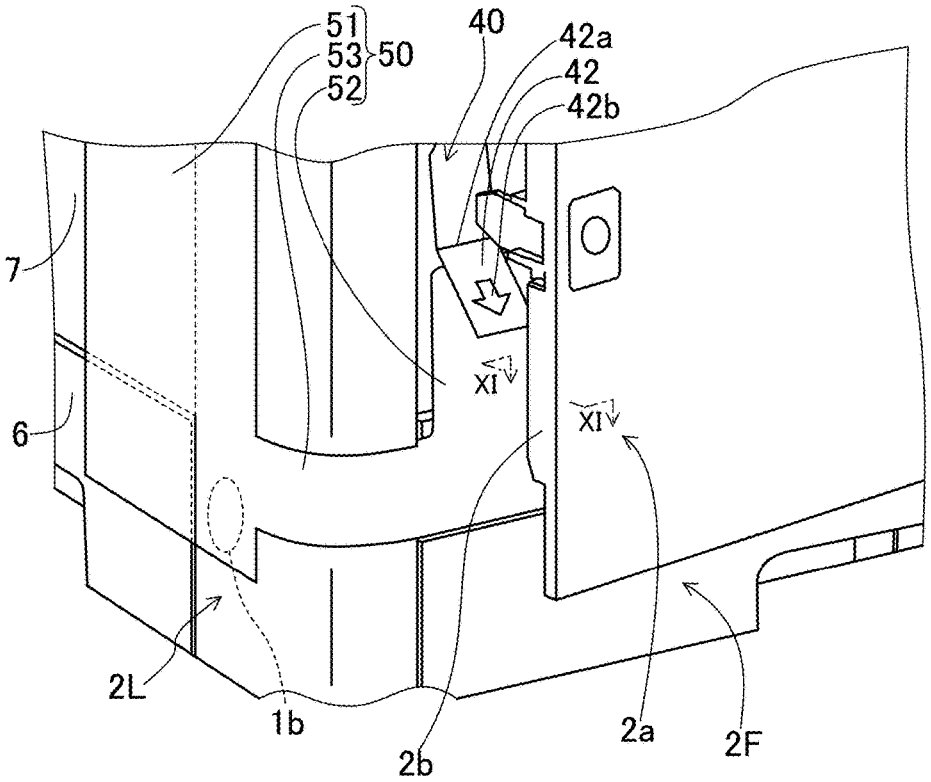
FIG. 10 is an enlarged perspective view illustrating the vicinity of an operation guide label of an image forming apparatus in a state in which an opening and closing cover is half-opened.
Figure 11:
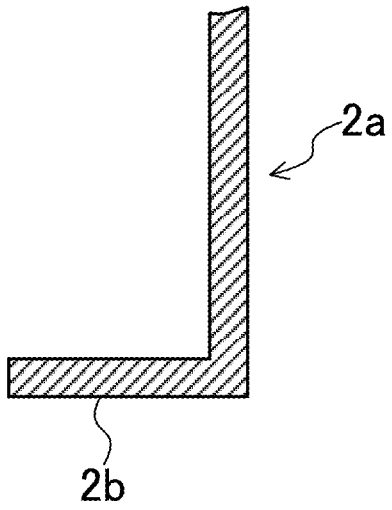
FIG. 11 is a sectional view taken along line XI-XI of FIG. 10.
Figure 12:
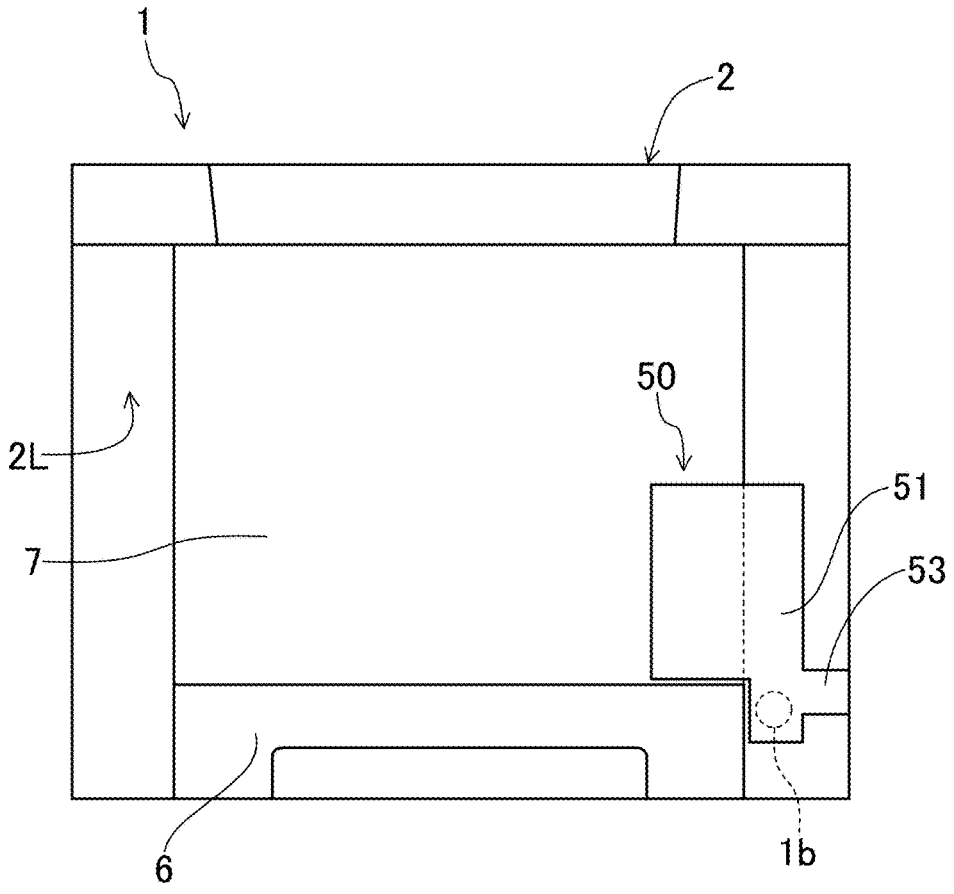
FIG. 12 is a view corresponding to FIG. 8, which illustrates another embodiment.

As illustrated in FIG. 10, the connection part 53 connects the lower end portion of the first end portion of the first label part 51 to the lower end portion of the left end portion of the second label part 52. At the left end edge of the opening and closing cover 2*a*, a plate-like rib 2*b* extending in the up and down direction extends as illustrated in FIG. 11. When the plate-like rib 2*b* is assumed to extend up to the lower end edge of the left end edge of the opening and closing cover 2*a*, the connection part 53 interferes with the plate-like rib 2*b* and thus is complicatedly bent. As a consequence, the connection part 53 may be broken or the opening and closing cover 2*a* may be difficult to be closed. In the present embodiment, in order to solve this problem, the plate-like rib 2*b* is not provided to a part of the left end edge of the opening and closing cover 2*a*, which corresponds to the connection part 53.

As described above, the operation guide label 50 of the present embodiment includes the first label part 51 adhered to the left side surface 2L of the casing 2 so as to cover the entire power switch 1*b*, the second label part 52 adhered to the predetermined surface part 30A on the opening and closing cover 2*a* side (the front side) in the image forming apparatus 1, and the connection part 53 for connecting the first label part 51 and the second label part 52 to each other.

According to this configuration, even though a user purchases the image forming apparatus 1 and initially intends to turn on the power switch 1*b*, since the power switch 1*b* has been covered by the first label part 51, it is not possible to find the power switch 1*b*. Then, the user becomes aware of the existence of the first label part 51 while looking for the power switch 1*b*. Since the first label part 51 has been made to perform a display urging the seal member 40 to be pulled out before turning on the power switch 1*b*, it is highly probable that the user will become aware of this display and pull out the seal member 40. Furthermore, even though the user does not become aware of the display of the first label part 51, since the first label part 51 is connected to the second label part 52 via the connection part 53, the user opens the opening and closing cover 2*a* and is induced to the second label part 52. Since the second label part 52 has also been made to perform a display urging the pulling-out of the seal member 40, it is possible to urge the user to pull out the seal member 40 again. Even though the user does not become aware of the display of the second label part 52, since the user is forced to open the opening and closing cover 2*a* by the aforementioned induction effect, the user becomes aware of the existence of the grasping part 42 of the seal member 40 protruding from the opening and closing cover 2*a* side (the front side) of each of the toner containers 30Bk, 30M, 30C, and 30Y. By so doing, it is possible to allow the user to pull the grasping part 42 of the seal member 40.

Furthermore, in the present embodiment, the first label part 51 itself has an adhesive surface and is adhered to the left side surface 2L of the casing 2 via the adhesive surface. On the other hand, the second label part 52 itself has no adhesive surface and is adhered to the surface part 30A by the adhesive member 60 forming a separate body from the operation guide label 50.

According to this configuration, the first label part 51 can be difficult to be peeled off as much as possible and the second label part 52 can be easy to be peeled off as much as possible. Consequently, when a user peels off the operation guide label 50 covering the power switch 1*b*, peeling off the first label part 51 from the second label part 52 via the connection part 53 requires less efforts of a user as compared with a case of peeling off the operation guide label 50 from the first label part 51. Thus, a user is induced to open the opening and closing cover 2*a* in order to peel off the second label part 52. In this way, it is possible to reliably allow user's attention to be directed to the grasping part 42 protruding from each of the toner containers 30Bk, 30M, 30C, and 30Y.

Particularly, in the present embodiment, since the whole of one side surface of the first label part 51 in the thickness direction serves as an adhesive surface, when peeling off the first label part 51, a user needs to peel off the first label part 51 by scratching the end edges of the first label part 51 with his/her nails. In contrast, since the adhesive member 60 for allowing the second label part 52 to be adhered to the predetermined surface part 30A includes the adhesive part 60*a* having an adhesive surface and the non-adhesive part 60*b* concatenated to the adhesive part 60*a*, a user can grasp the non-adhesive part 60*b* with his/her fingers to easily peel off the adhesive member 60 without scratching end edges of the adhesive part 60*a* with his/her nails. Consequently, the first label part 51 can be difficult to be peeled off as much as possible and the second label part 52 can be easy to be peeled off as much as possible. Thus, it is possible to more reliably obtain an effect that the aforementioned user is induced to the second label part 52.

Furthermore, the second label part 52 is arranged so as to overlap the distal end portion of the grasping part 42 of the seal member 40 when viewed from the opening and closing cover 2*a* side, so that it is possible to reliably allow a line of sight of a user induced to the second label part 52 to be directed the grasping part 42 of the seal member 40. Thus, it is possible to further enhance an effect for urging a user to pull out the seal member 40.

Furthermore, the predetermined surface part 30A with the second label part 52 adhered thereto serves as a surface of each of the toner containers 30Bk, 30M, 30C, and 30Y, which faces the opening and closing cover 2*a* side. In this way, the attention of a user induced to the second label part 52 is directed to the toner containers 30Bk, 30M, 30C, and 30Y and thus can be directed to the seal member 40 mounted to the toner containers 30Bk, 30M, 30C, and 30Y.

Furthermore, the second label part 52 is arranged across the whole of the four toner containers 30Bk, 30M, 30C, and 30Y when viewed from the opening and closing cover 2*a* side. Consequently, it is possible to allow user's attention to be directed to the seal member 40 mounted to all the toner containers 30Bk, 30M, 30C, and 30Y.

Moreover, in the present embodiment, the first label part 51 is adhered to the left side surface 2L of the casing 2 so as to cover a part of the manual feed tray 7 in a closed state and a part of the sheet feed cassette 6 in a closed state, in addition to the power switch 1*b*.

By so doing, it is possible to reliably create a situation in which a user should peel off the operation guide label 50. That is, a user can also forcedly press the power switch 1*b* without peeling off the first label part 51. When a user is not intended to peel off the first label part 51, it is not possible to allow a line of sight of the user to be induced to the second label part 52 connected to the first label part 51. However, according to the aforementioned configuration, since the first label part 51 covers a part of the manual feed tray 7 and the sheet feed cassette 6, even though a user turns on the power switch 1*b* without peeling off the first label part 51, it is not possible to supply the recording sheet P to the image forming apparatus 1 so long as the first label part 51 is not peeled off. Consequently, a user should peel off the first label part 51. In this way, it is possible to allow a line of sight of a user to be sequentially induced to the first label part 51, the connection part 53, the second label part 52, and the seal member 40.

Other Embodiments

In the aforementioned embodiment, the first label part 51 is configured to cover a part of the sheet feed cassette 6 and a part of the manual feed tray 7, in addition to the power switch 1*b*; however, the technology of the present disclosure is not limited thereto and for example, the first label part 51 may be configured to cover the power switch 1*b* and a part of the manual feed tray 7 and not to cover the sheet feed cassette 6. In this way, it is possible to prevent the operation guide label 50 from being peeled off due to rattling of the sheet feed cassette 6 during the transportation of the image forming apparatus 1.

In the aforementioned embodiment, one side surface of the first label part 51 in the thickness direction serves as an adhesive surface, so that the first label part 51 is adhered to the left side surface 2L of the casing 2; however, the technology of the present disclosure is not limited thereto and the first label part 51 may be adhered to the left side surface 2L by a solid adhesive member such as a gummed tape.

In the aforementioned embodiment, the first label part 51 is configured to cover the entire power switch 1*b* when viewed from the left side; however, the technology of the present disclosure is not limited thereto and it is sufficient if the first label part 51 covers at least a part of the power switch 1*b*.

In the aforementioned embodiment, the first label part 51 covers a part of the manual feed tray 7 when viewed from the left side; however, the first label part 51 may cover the entire manual feed tray 7. Furthermore, the first label part 51 covers a part of the sheet feed cassette 6 when viewed from the left side; however, the first label part 51 may cover the entire sheet feed cassette 6.

What is claimed is:

1. An image forming apparatus comprising:

a casing for receiving therein an image forming unit and a toner container;

a seal member for sealing a toner replenishment port of the toner container received in the casing;

an operation guide label made to perform a display urging the seal member to be pulled out;

a first side surface constituting a part of an outer side surface of the casing;

a second side surface adjacent to the first side surface in the outer side surface of the casing;

a power switch provided in the first side surface; and an opening and closing cover for toner container exchange provided on the second side surface, wherein the seal member has a grasping part which protrudes from a surface of the toner container, which is on a side of the opening and closing cover, and is graspable by a user when the seal member is pulled out, and the operation guide label includes a first label part adhered to the first side surface so as to cover at least a part of the power switch, a second label part adhered to a predetermined surface part on the side of the opening and closing cover in the casing, and a connection part for connecting the first label part and the second label part to each other through a gap between an end edge of the opening and closing cover, and the casing in a state in which the opening and closing cover is closed.

2. The image forming apparatus of claim 1, wherein the first label part itself has an adhesive surface and is adhered to the first side surface via the adhesive surface, the second label part is adhered to the predetermined surface part by an adhesive member forming a separate body from the operation guide label, and the adhesive member includes an adhesive part having an adhesive surface and a non-adhesive part concatenated to the adhesive part and having no adhesive surface.

3. The image forming apparatus of claim 1, wherein the second label part is arranged so as to overlap at least a part of grasping part when viewed from the side of the opening and closing cover.

4. The image forming apparatus of claim 1, wherein the predetermined surface part is a surface of the toner container, which is on a side of the opening and closing cover.

5. The image forming apparatus of claim 1, wherein the toner container is provided in a plural number, a plurality of the toner containers are arranged in a low in a transverse direction perpendicular to a height direction when viewed from the side of the opening and closing cover, and the second label part is arranged across the plural toner containers when viewed from the side of the opening and closing cover.

6. The image forming apparatus of claim 1, wherein the image forming apparatus has a manual sheet feed tray configured to be openable and closable by rotating and constituting a part of the first side surface in a closed state, and a sheet feed cassette configured to be openable and closable by sliding in a horizontal direction and constituting a part of the first side surface in a closed state, and the first label part is adhered to the first side surface so as to cover at least a part of the manual feed tray in the closed state and at least a part of the sheet feed cassette in the closed state, in addition to the power switch.

7. The image forming apparatus of claim 1, wherein the image forming apparatus has a manual sheet feed tray configured to be openable and closable by rotating and constituting a part of the first side surface in a closed state, and a sheet feed cassette configured to be openable and closable by sliding in a horizontal direction and constituting a part of the first side surface in a closed state, and the first label part is adhered to the first side surface so as to cover at least a part of the manual feed tray in the closed state, in addition to the power switch, and not to cover the sheet feed cassette in the closed state.

8. The image forming apparatus of claim 1, wherein the opening and closing cover is provided on the end edge with a plate-like rib along the end edge, and the plate-like rib is not provided on a part corresponding to the connection part in the end edge of the opening and closing cover.

* * * * *